US005412970A

United States Patent [19]

Kawamura et al.

[11] Patent Number: 5,412,970

[45] Date of Patent: May 9, 1995

[54] GUIDING METHOD FOR STEEL MATERIALS TO BE ROLLED AND ROLLER GUIDE SYSTEM THEREFOR

[75] Inventors: Tadashi Kawamura; Yoshiaki Yamaguchi; Sadao Yoshizawa; Shoji Okada; Makoto Endo; Tatsuya Kutsuwada; Atsumu Nakamura; Akira Manabe; Takaya Suzuki; Kyouhei Murata, all of Sapporo, Japan

[73] Assignee: Kotobuki Sangyo Kabushiki Kaisha, Kokkaido, Japan

[21] Appl. No.: 88,062

[22] Filed: Jul. 6, 1993

[30] Foreign Application Priority Data

Nov. 6, 1992 [JP] Japan ..... 4-321420
Jan. 18, 1993 [JP] Japan ..... 5-021611

[51] Int. Cl.[6] ..... B21B 39/16
[52] U.S. Cl. ..... 72/250
[58] Field of Search ..... 72/250, 251, 408

[56] References Cited

U.S. PATENT DOCUMENTS 4,790,164 12/1988 Rothe ..... 72/250

FOREIGN PATENT DOCUMENTS 58-77709 5/1983 Japan .

OTHER PUBLICATIONS

"Principles of Continuous Gauge Control in Sheet and Strip Rolling", W. C. F. Hessenberg et al., Research on the Rolling Strip. A symposium of selected papers, 1948–1958, pp. 185–191.

*Primary Examiner*—Lowell A. Larson
*Assistant Examiner*—Thomas C. Schoeffler
*Attorney, Agent, or Firm*—Jordan and Hamburg

[57] ABSTRACT

In a roller guide apparatus for guiding a steel material to be rolled into a rolling mill machine, a ratio (K/M) of an elastic constant (K [N/mm]) of the roller guide portion of a roller guide apparatus to a gradient (M [N/mm]) in a plasticity characteristic curve obtained when pressing the steel material nipped between the guide rollers in rolling is determined to be 0.5 or more, to thereby prevent the steel material from tilting between the guide rollers. As a result, dimensional accuracy in sectional shape and size of an end product can be improved, and miss-rolling can be prevented, thus producing high-quality rolled steel products without surface defects with remarkably high yield rate and productivity.

2 Claims, 4 Drawing Sheets

S : Space between rollers
h : Representative size of steel material to be rolled

GUIDING METHOD FOR STEEL MATERIALS TO BE ROLLED AND ROLLER GUIDE SYSTEM THEREFOR

BACKGROUND OF THE INVENTION

1. Field of the Invention

This invention relates to a roller guide method and system for guiding steel materials between guide rollers into a rolling mill machine to roll the steel materials to linear steel products having various sectional shapes such as wire rods, various steel bars, and section steels including an H-section beam, while preventing the steel material from tilting in a nip space defined between the guide rollers in the course of rolling.

2. Description of the Prior Art

A conventional roller guide apparatus for guiding a steel material to be rolled to linear steel products, section steel products and such has a mere function of preventing miss-rolling possibly caused by failure of introducing the steel material thereinto. However, it has been known that the conventional roller guide apparatus cannot disadvantageously satisfy the recent rigorous demands for accuracy in sectional shape and size of rolled steel products resultantly obtained. To be concrete, the conventional apparatus cannot achieve the accuracy in roundness of a wire rod or other dimensional accuracy of the rolled steel products when the steel material to be rolled is nipped and guided between the guide rollers on a tilt into a subsequent rolling mill machine.

Thus, there have been so far proposed methods for effectively preventing the miss-rolling and tilting of the steel material as specified above in the course of rolling. One of the proposed prior art methods is disclosed in Japanese Patent Publication No. SHO 60-40933 (hereinafter referred to as "First Prior Art") for a guiding method for a steel material to be rolled. In this method, in order to reliably introduce a wire rod of steel material into a nip space defined between guide rollers and further prevent tilting of the wire rod in the nip space, the guide rollers between which the wire rod is guided are kept somewhat apart from each other to leave the nip space wider than the diameter of the wire rod to be passed until the leading end of the wire rod reaches the guide rollers, and then, the guide rollers are brought close to each other to narrow down the aforesaid nip space when the leading end of the wire rod enters in between the guide rollers. After the tail end of the wire rod has passed therethrough, the nip space between the guide rollers is brought to the status quo ante.

Also, Japanese Patent Application Public Disclosure No. SHO 52-66865 (hereinafter referred to as "Second Prior Art") discloses a roller guide apparatus capable of nipping a steel material between guide rollers with a prescribed load in the course of rolling so as to accomplish precision rolling. Other methods of imparting prestress (preload) to a roller guide apparatus to increase the rigidity of the apparatus are disclosed in Japanese Utility Model Publications Nos. SHO 39-24250 ("Third Prior Art") and SHO 61-1929 ("Fourth Prior Art").

The guiding method of the First Prior Art as noted above adopts the idea of imparting an "embracing force" for nipping the steel material with the rollers. However, it has been experimentally known that a wire rod may possibly tilt even when being applied with the embracing force as a matter of fact. There has been generally believed the cause such that, in order to cope with the present day tendencies in rolling toward application of high-strength steel materials or high-deformation resistance steel materials such as special steel and diversified small-quantity production of rolled steel products, even a roller guide apparatus essentially suitable for specific rolling commonly tends to be applied to various rolling systems for high-speed rolling and high-load rolling such as low temperature rolling, which are effected under different conditions for producing rolled steel products of varied kinds, consequently suffering from increased load. The First Prior Art discloses the use of the hydraulic system for increasing the embracing force with which the steel material is retained between the guide rollers. However, the hydraulic system used therein is controlled to assume either its operative ON state or its inoperative OFF state. As a result, the embracing force produced by the hydraulic system is maintained just constant in the state of nipping the steel material between the guide rollers. The constant embracing force signifies that the roller guide system composed of the guide rollers is formed of a substantially non-rigid, flexible structure. Such a flexible structure offers no elastic resistance to the force to cause the guide rollers to be push open, which is produced by the steel material tilting, even when the steel material nipped between the guide rollers begins to have a tilt, whereby tilting of the steel material in the nip space between the guide rollers cannot be prevented.

Even in the Third Prior Art and Fourth Prior Art both teaching the method for application of prestress, increments determined stepwise in rigidity of the roller guide apparatus are not sufficient for meeting the severe rolling conditions of late years. Thus, these prior art also cannot prevent the steel material from inevitably tilting between the guide rollers.

Every prior art entails a disadvantage such that tilting of the steel material to be rolled to linear steel products including wire rods and steel bars or section steel products inevitably occurs, consequently giving rise to inconveniences of miss-rolling or deterioration of dimensional accuracy in sectional shape and size of the rolled steel product.

OBJECT OF THE INVENTION

An object of this invention is to provide a method and system capable of preventing a steel material to be rolled from tilting between guide rollers in the course of rolling so as to avoid inconveniences of miss-rolling, deterioration of dimensional accuracy in sectional shape and size of a rolled steel product and occurrence of surface defects.

SUMMARY OF THE INVENTION

To attain the object described above according to this invention, there is provided a method for guiding a steel material to be rolled into a rolling mill machine by use of a roller guide apparatus having guide rollers placed between rolling stand means in a roller guide portion, wherein a ratio (K/M) of the elastic constant (K [N/mm]) of the roller guide portion of the roller guide apparatus to a gradient (M [N/mm]) in a plasticity characteristic curve which is obtained when pressing the steel material to be nipped between the guide rollers in rolling is determined to be 0.5 or more.

This invention further provides a roller guide apparatus for guiding a steel material to be rolled into a rolling mill machine, which comprises a roller guide portion including guide rollers placed between rolling stand means, wherein a ratio (K/M) of the elastic constant (K [N/mm]) of the roller guide portion to a gradient (M [N/mm]) in a plasticity characteristic curve which is obtained when pressing the steel material between the guide rollers is determined to be 0.5 or more.

Though the roller guide apparatus having small rigidity allows the guide rollers to open with ease, thus tilting the steel material in the nip space between the guide rollers, the steel material guided between the guide rollers is prevented from tilting by increasing the elastic constant K so as to sufficiently withstand the embracing force applied to the steel material.

By toughening the roller guide apparatus in accordance with the ratio specified above, the steel material no longer tilts in the nip space between the guide rollers, so that dimensional accuracy in sectional shape and size of an end product can be much improved. According to this invention, since miss-rolling can be prevented, the yield rate and productivity of rolled steel products can be markedly increased.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

This invention relates to a method and system capable of adequately toughening a roller guide apparatus so as to improve dimensional accuracy in sectional shape and size of an end product and prevent miss-rolling, thus producing high-quality rolled steel products without surface defects with remarkably high yield rate and productivity.

In a conventional roller guide apparatus having a flexible structure, even if a prescribed embracing force to be imparted to the roller guide apparatus is weak, a steel material to be rolled is apt to tilt in a nip space between guide rollers of the roller guide apparatus while being rolled. However, the conventional roller guide apparatus which has been designed without regard to the embracing force cannot withstand an excessive embracing force enough for preventing the steel material from tilting in the nip space between the guide rollers. That is, it becomes apparent that, if the elastic constant K of the roller guide portion defined between the guide rollers is large in some degree, the steel material guided between the guide roller will tilt.

Then, the inventors of this invention studied out on what degree the elastic constant K should be increased to, and found that a characteristic curve representing the relation between rolling load exerted on the steel material guided between the guide rollers in the tilt state and reduction, in other words, a gradient M (absolute value) in a plasticity characteristic curve of the steel material in the tilt state, serves as an index of a required adequate elastic constant K.

Figure 1:
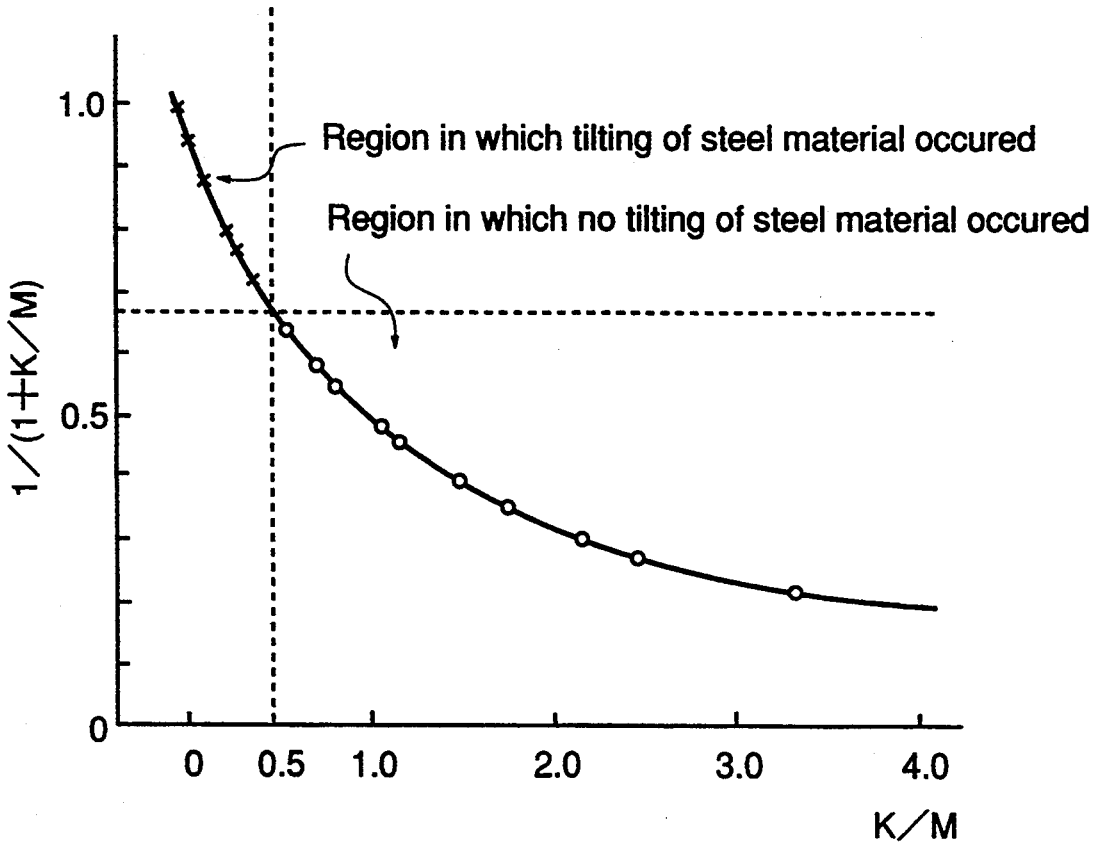
FIG. 1 is a graph showing the experimental results on tilting of steel materials to be rolled, which is represented by the axis of ordinates $1/(1+K/M)$ and the axis of abscissas K/M.

In FIG. 1, There is shown a graph represented by the axis of ordinates $1/(1+K/M)$ and the axis of abscissas K/M, which was obtained as the outcome of the studies which have been done by the inventors with relation to the state in which the steel material to be rolled tilts under all sorts of rolling conditions. As is obvious from FIG. 1, where a ratio (K/M) of the elastic constant K to the gradient M is determined to be 0.5 or more, the steel material nipped between the guide rollers no longer tilts.

In FIG. 1, x shows that the steel material being rolled is caused to tilt, and ○ shows that the steel material does not tilt.

The determination of the ratio of 0.5 or more should be applied to each roller guide apparatus for all rolling stand means so as not to cause the steel material guided by and nipped between the guide rollers in rolling to tilt in any rolling stand means. Accordingly, the invention having the purpose of preventing the steel material from tilting between the guide rollers may be summarized in three measures as follows:

The first measure is a method for guiding the steel material to be rolled into a rolling mill machine by use of the roller guide apparatus, in which the ratio K/M of the elastic constant K [N/mm] of the roller guide portion to the gradient M [N/mm] in the plasticity characteristic curve which is obtained when pressing the steel material between the guide rollers is determined to be 0.5 or more.

The second measure is the roller guide apparatus for guiding the steel material to be rolled into a rolling mill machine, having the condition that the ratio K/M of the elastic constant K [N/mm] of the roller guide portion to the gradient M [N/mm] in the plasticity characteristic curve which is obtained when pressing the steel material between the guide rollers is determined to be 0.5 or more.

The third measure is a roller guide system for guiding a steel material to be rolled into a rolling mill machine, which comprises a series of roller guide apparatuses each having a roller guide portion with guide rollers placed between rolling stand means, wherein the ratio K/M of the elastic constant K [N/mm] of the roller guide portion to the gradient M [N/mm] in the plasticity characteristic curve which is obtained when pressing the steel material between the guide rollers is determined to be 0.5 or more.

Thus, by adopting two factors of the elastic constant K of the roller guide apparatus and the gradient M in the plasticity characteristic curve of the steel material, the tilting of the steel material guided in the nip space between the guide rollers can be prevented. The gradient M must be chosen from the maximum values determined according to the steel material to be rolled and the rolling condition.

In the aforementioned First Prior Art, the embracing force with which the steel material is nipped between the guide rollers is constant, i.e. the roller guide apparatus is formed of a flexible structure in which the rigidity between the guide rollers is zero (K=0) under a constant hydraulic pressure. In this case, if the nip space between the guide rollers is widened as the steel material guided between the guide rollers begins to tilt, the flexible structure cannot offer resistance to the force to cause the guide rollers to be pushed open which is producing the steel material tilting, resulting in permitting the steel material guided between the guide rollers to tilt. Hence, the hydraulic system in the conventional rolling apparatus must be improved in order to prevent the tilting of the steel material.

Figure 2:
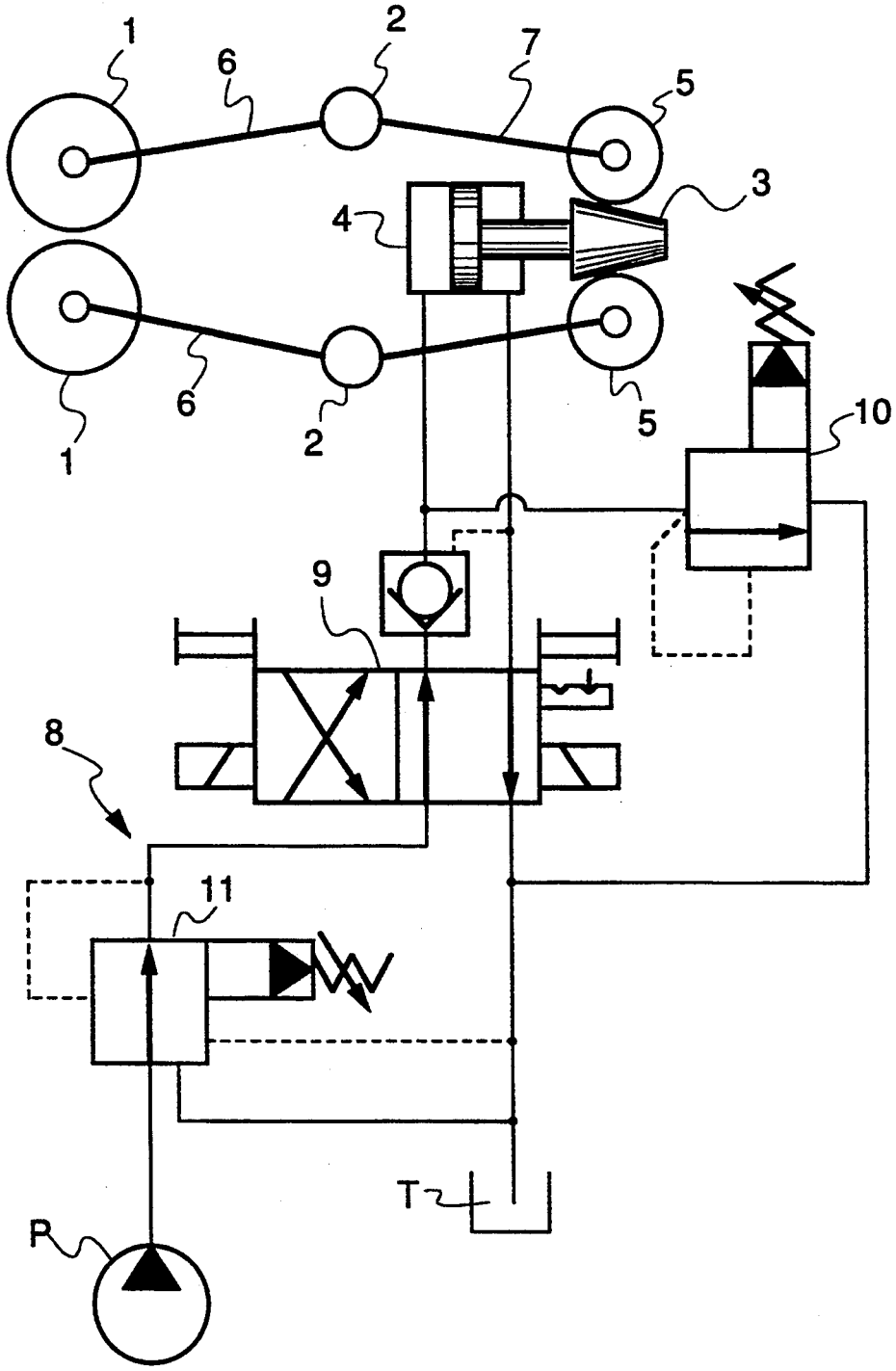
FIG. 2 is a view showing one embodiment of a roller guide apparatus according to this invention, which is provided with a hydraulic system for increasing rigidity of the roller guide apparatus when the steel material begins to tilt.

The roller guide apparatus according to this invention is further featured by a hydraulic system as illustrated in FIG. 2. The hydraulic system comprises a control device 8 having a hydraulic cylinder 4 for producing hydraulic pressure to be exerted on the guide rollers 1 so that a nip space defined between the guide rollers 1 can be controlled. The hydraulic system is airtightly closed upon setting the hydraulic pressure to a required pressure level so as to nip the steel material between the guide rollers with required embracing force produced by the hydraulic system. When the hydraulic pressure produced by the hydraulic system reaches a prescribed pressure less than a loaded hydraulic pressure for the embracing force which corresponds to the elastic limit of the roller guide apparatus, the hydraulic system is deactivated to reduce the hydraulic pressure.

Since the hydraulic system for controlling the embracing force with which the steel material is nipped between the guide rollers is designed according to this invention, the rigidity K between the guide rollers can be increased to its desired finite value. As a result, the steel material guided can be prevented from tilting and reliably retained between the guide rollers. If the nip space between the guide rollers is widened when the steel material begins to tilt, consequently to increase the hydraulic pressure produced by the hydraulic system, the roller guide apparatus is no longer deformed nor broken because it can be controlled within its elastic limit.

Figure 3:
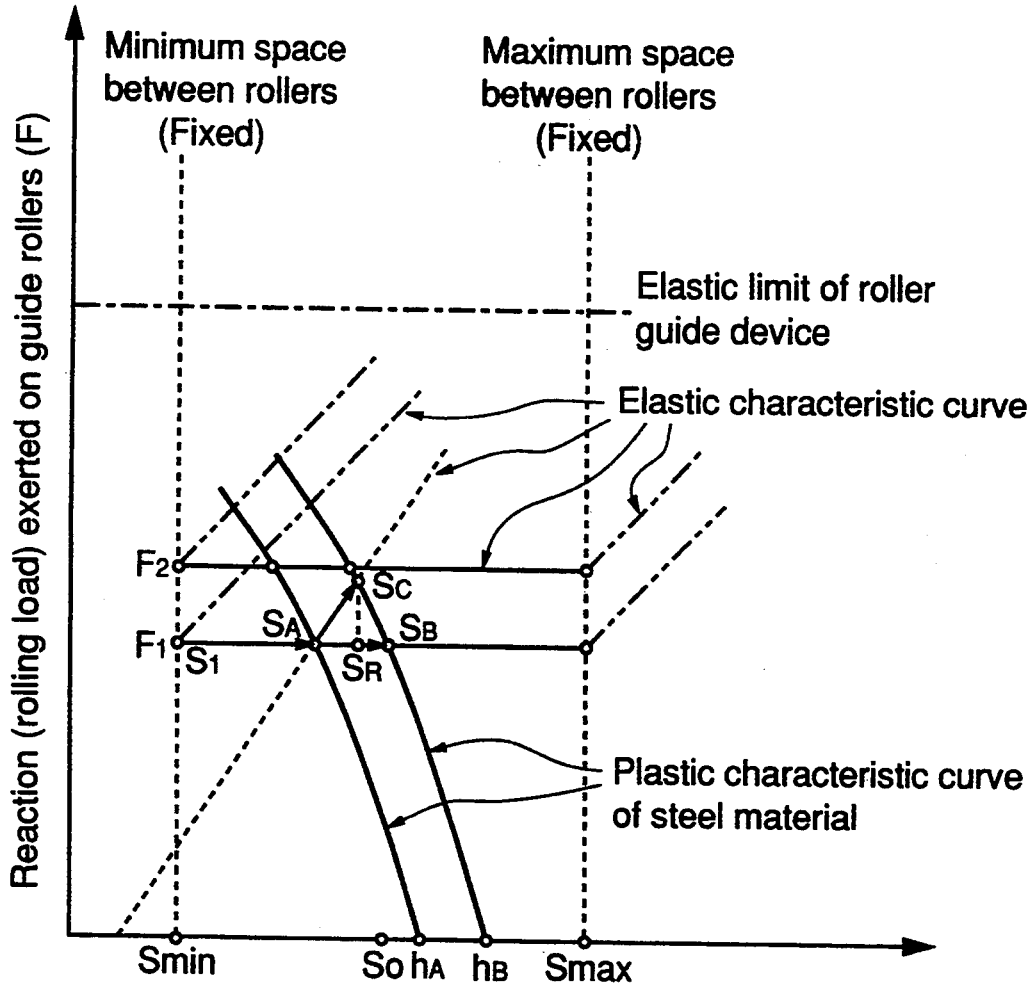
FIG. 3 is a graph representing the elastic characteristic of the roller guide apparatus capable of controlling the embracing force produced by the guide rollers or the nip space between the guide rollers and the plasticity characteristic of the steel materials to be rolled.

In FIG. 3, there are shown the elastic characteristic curve of the roller guide apparatus capable of controlling the embracing force produced by the guide rollers and the plasticity characteristic curve of the steel materials to be rolled. In FIG. 3, the mark hA represents the representative size of the steel material nipped between the guide rollers in its normal state, the mark hB represents the representative size of the steel material nipped between the guide rollers in its tilted state. The marks SA, SB and SC represent the working points corresponding to the aforesaid representative sizes, respectively.

Figure 4:
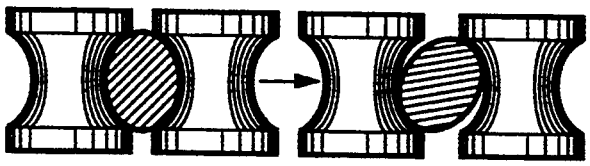
FIG. 4 is a view showing the state of nipping the steel material between the guide rollers in the normal state and the state of embracing the steel material having a tilt.

In FIG. 4 is shown the state in which the steel material somewhat tilts in the nip space between the guide rollers. In this drawing, the left shows the normal embraced state of the steel material, and the right shows the tilted state of the same.

Figure 5:
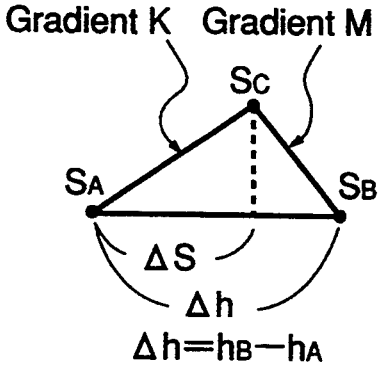
FIG. 5 is an explanatory diagram showing the sphere defined among the lines connecting the points SA, SB and SC in FIG. 3.

FIG. 5 shows the sphere defined among the lines connecting the intersection points SA, SB and SC of the elastic and plasticity characteristic curves in FIG. 3. The length from the point SA to the point SB corresponds to the extent in which the working point moves when the representative size of the steel material nipped between the guide rollers in its tilted state is changed from hA to hB in the case that the embracing force is kept constant. The length from SA to SC corresponds to the extent in which the working point moves as the steel material guided between the guide rollers tilts under the conditions given by the elastic characteristic curve for the hydraulic system used in this invention.

The intersection points SA, SB and SC of the elastic characteristic curve and the plasticity characteristic curve represent the actual working points corresponding to the representative size of the steel material guided between the guide rollers, that is, the representative size of the steel material at the exit of the nip space between the guide rollers.

If the embracing force is constant, K=0 is theoretically true. When the tilting of the steel material guided between the guide rollers is slightly increased, the representative size of the steel material can be supposed to be enlarged slightly. At this time, the relationship as expressed by the following Equation (1) exists between the variation ΔS of the nip space between the guide rollers and the difference Δh in the steel material having a representative size.

$$\Delta S=[M/(K+M)].\Delta h=[b\ 1+K/M)].\Delta h \quad (1)$$

This can be rewritten as follows:

$$\Delta S/\Delta h=1/[1+K/M)] \quad (2)$$

This Equation (2) serves as an index of the degree of difficulty in opening the guide rollers when the tilting of the steel material being nipped between the guide rollers becomes conspicuous. The smaller the value of the right side in Equation (2) is, the narrow the nip space between the guide roller is. In this case, it can be understood from Equation (2) that the resistance of the roller guide apparatus to the tilting of the steel material becomes large.

Thus, it is apparent from FIG. 1 that, when the condition expressed by Equation (3) below is satisfied, the steel material guided between the guide rollers does not tilt.

$$1/(1+K/M)\leqq\tfrac{2}{3};\text{namely, } k/M\geqq 0.5 \quad (3)$$

Also, it is desirable to determine the ratio K/M as large as possible in order to prevent the guide rollers from opening when the steel material begins to tilt, as understood from FIG. 3.

It is substantiated by this fact that the tilting of the steel material can be prevented by determining the elastic constant K between the guide rollers to the gradient M of 0.5 or more in the plasticity characteristic curve of the steel material to be guided. Therefore, the gradient M must be chosen from the maximum values determined according to the steel material to be rolled and the rolling condition.

In FIG. 2, there is shown the roller guide apparatus having the hydraulic system which is effected to increase rigidity of the roller guide apparatus when the steel material begins to tilt in order for preventing the tilting of the steel material being nipped between and guided by the guide rollers. The hydraulic system has three functions of (1) varying prescribed hydraulic pressure, (2) closing a hydraulic circuit of the hydraulic system after setting the hydraulic pressure, and (3) opening the hydraulic circuit when the pressure produced by the hydraulic system reaches a prescribed hydraulic pressure within the elastic limit of the roller guide apparatus.

One example of a mechanism for controlling the nip space between the guide rollers with the hydraulic cylinder 4 comprises a cotter 3 which is driven by the hydraulic cylinder 4 so as to narrow the nip space between the guide rollers to increase the embracing force with which the steel material is nipped between the guide rollers. In this mechanism having the united cotter 3 and hydraulic cylinder 4 arranged in line and the connected cotter and pressure rollers 5, the resultant elastic constant KC is given by Equation (4) below:

$$1/KC = 1/K1 + 1/K2 \quad (4)$$

wherein, K1 represents an elastic constant between the cotter 3 and the hydraulic cylinder 4, and K2 represents an elastic constant between the cotter 3 and the pressure rollers 5.

Since K1=0 when the embracing force is constant, the following is given:

$$KC = 0 \quad (5)$$

It is apparent that, since $K1 = \infty$ when using a hydraulic system of a completely closed type, the rigidity of the roller guide apparatus becomes a finite value as follows:

$$KC = K2 \quad (6)$$

Thus, the method for increasing the rigidity according to the invention is remarkably favorable for preventing the steel material guided with the guide rollers from tilting rather than the conventional method in which the hydraulic pressure (embracing force) is controlled to be constant.

By determining the rigidity K between the guide rollers in the guide roller apparatus to larger than one-half the gradient M in the plasticity characteristic curve, the steel material to be rolled is retained between the guide rollers in its normal state. If the guide rollers open to allow the steel material to tilt, the rollers are instantaneously forced back with the rigidity K to bring about a function of preventing the steel material from tilting, to thereby retain the steel material in its normal state. However, only by determining the rigidity K of the roller guide apparatus to larger than one-half the gradient M in the plasticity characteristic curve of the steel material to be guided, the embracing force constantly produced by the guide rollers is not sufficient to prevent the steel material from tilting. That is, the rigidity K which is determined to be more than 0.5M so that KC=K2, but not KC=0, is effective upon setting the embracing pressure level by using the hydraulic system of a closed type, as the steel material nipped between the guide rollers begins to tilt.

The prevention of the tilting of the steel material enables to fulfill an advanced and elaborate rolling system capable of satisfying the recent rigorous demands for accuracy in producing high-quality rolled steel products without surface defects and increasing the yield rate and productivity of the rolled steel products.

However, in the case of $K/M > 5$, the steel material is forcibly pressed by the guide rollers, thereby causing surface defects to occur.

Figure 6:
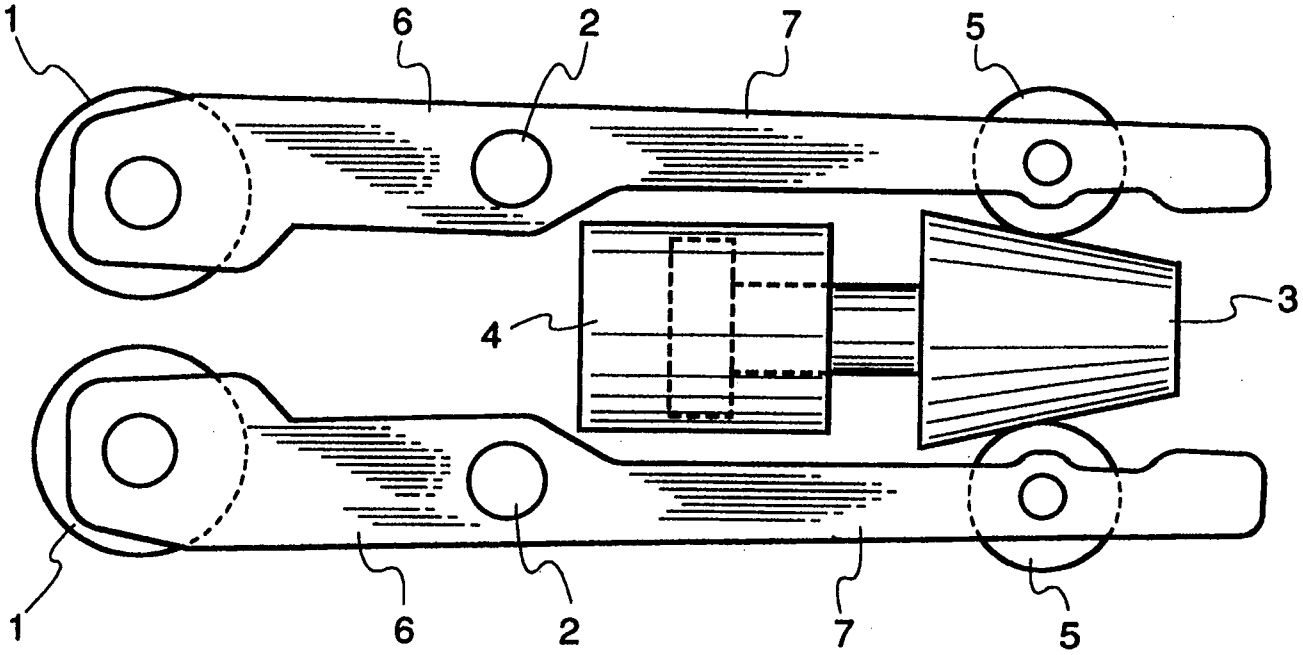
FIG. 6 is a front view showing the principal portion of the roller guide apparatus for controlling the nip space between the guide rollers.

In order to increase the elastic constant K of the roller guide apparatus between the rolling stand means, the geometrical moment of inertia of each of supporting arms 6 and 7 and the rigidity around holes for pivot pins 2 are increased as shown in FIG. 2 and FIG. 6. The space for setting the guide rollers is enlarged to sufficiently fulfill the function of preventing the steel material from tilting in rolling.

The control device 8 for the hydraulic system is operated to supply hydraulic pressure to a supply side of the cylinder 4 to thrust the cotter 3 forward in the state shown in FIG. 2, to thereby force the pressure rollers 5 outward. Consequently, the space between the rollers 5 is widened. And then, when a change valve 9 is switched over, the hydraulic pressure is supplied to a discharge side of the cylinder 4 to move the cotter 3 backward and narrow the space between the rollers 5. The embracing force for nipping the steel material between the guide rollers is set in accordance with the hydraulic pressure produced by the hydraulic system and retained at the prescribed pressure level by fixing the change valve 9 to close the hydraulic system. The hydraulic system is controlled so that the elastic constant K2 between the cotter 3 and the pressure rollers 5 is maintained equal to the resultant elastic constant KC touched upon above so as to effect the rigidity of $K \geqq 0.5M$.

The control device 8 is provided with control valves 10 and 11 for releasing the hydraulic system at the prescribed pressure level within the elastic limit of the roller guide apparatus.

The roller guide apparatus according to this invention can of course be applied for any materials to be rolled other than steel such as metallic materials.

As is apparent from the foregoing, according to this invention, the steel material being nipped between the guide rollers can be prevented from tilting, resulting in improving dimensional accuracy in sectional shape and size of an end product. Besides, since miss-rolling can be also prevented, high-quality rolled steel products without surface defects can be produced with remarkably high yield rate and productivity.

It is further understood by those skilled in the art that the foregoing description is a preferred embodiment of the disclosed device and that various changes and modifications may be made in the invention without departing from the spirit and scope thereof.

What is claimed is:

1. In a method for guiding a steel material to be rolled into a rolling mill machine by use of a roller guide apparatus having guide rollers placed between rolling stand means in a roller guide portion, said method comprising the steps of:

providing that a ratio (K/M) of an elastic constant (K) of said roller guide portion of said roller guide apparatus to a gradient (M) in a plasticity characteristic curve which is obtained when pressing said steel material guided between said guide rollers in rolling is at least equal to be 0.5 .

2. A roller guide apparatus for guiding a steel material to be rolled into a rolling mill machine comprising:

a roller guide portion, said roller guide portion including guide rollers placed between rolling stand means, a ratio (K/M) of an elastic constant (K) of said roller guide portion to a gradient (M) in a plasticity characteristic curve which is obtained when pressing said steel material guided between said guide rollers is at least equal to 0.5, a hydraulic system having a hydraulic cylinder for producing hydraulic pressure to be exerted on said guide rollers, thereby controlling a nip space defined between said guide rollers, said hydraulic system being closed in an air-tight manner upon setting the hydraulic pressure to a required pressure level so as to roll said steel material between said guide rollers with a required embracing force produced by said hydraulic system, and said hydraulic system being deactivated to reduce the hydraulic pressure when the hydraulic pressure produced by said hydraulic system reaches a prescribed pressure less than a load hydraulic pressure for the embracing force, which load hydraulic pressure corresponds to an elastic limit of the roller guide apparatus.

* * * * *